US011473346B2

(12) United States Patent
Nottebaum

(10) Patent No.: US 11,473,346 B2
(45) **Date of Patent: *Oct. 18, 2022**

(54) SECURING DEVICE COMPRISING A MANUALLY UNLOCKABLE FRONT HOOD

(71) Applicant: Kiekert AG, Heiligenhaus (DE)

(72) Inventor: Thorsten Nottebaum, Mühltal (DE)

(73) Assignee: Kiekert AG, Heiligenhaus (DE)

( * ) Notice: Subject to any disclaimer, the term of this patent is extended or adjusted under 35 U.S.C. 154(b) by 825 days.

This patent is subject to a terminal disclaimer.

(21) Appl. No.: 15/764,976

(22) PCT Filed: Sep. 29, 2016

(86) PCT No.: PCT/DE2016/100455

§ 371 (c)(1),
(2) Date: Mar. 30, 2018

(87) PCT Pub. No.: WO2017/054802

PCT Pub. Date: Apr. 6, 2017

(65) Prior Publication Data

US 2018/0266150 A1 Sep. 20, 2018

(30) Foreign Application Priority Data

Oct. 1, 2015 (DE) ..... 10 2015 116 669.0

(51) Int. Cl.
*E05B 81/14* (2014.01)
*E05B 81/16* (2014.01)
(Continued)

(52) U.S. Cl.
CPC ..... *E05B 83/243* (2013.01); *E05B 81/14* (2013.01); *E05B 81/16* (2013.01); *E05B 81/20* (2013.01); *E05B 83/24* (2013.01); *E05C 19/006* (2013.01)

(58) Field of Classification Search
CPC .... E05B 83/243; E05B 15/0046; E05B 83/24; E05B 81/16; E05B 81/14; E05B 81/20; E05C 19/006
See application file for complete search history.

(56) References Cited

U.S. PATENT DOCUMENTS 7,559,399 B2 * 7/2009 Lewis ..... B60R 21/38 180/274
7,934,293 B2 * 5/2011 Kalargeros ..... B60R 21/38 16/369

(Continued)

FOREIGN PATENT DOCUMENTS

DE 198 12 835 A1 9/1999
DE 10 2005 044 079 A1 3/2007

(Continued)

OTHER PUBLICATIONS

International Search Report and Written Opinion for corresponding Patent Application No. PCT/DE2016/100455 dated Feb. 21, 2017.

*Primary Examiner* — Kristina R Fulton
*Assistant Examiner* — Thomas L Neubauer
(74) *Attorney, Agent, or Firm* — Renner, Otto, Boisselle & Sklar, LLP

(57) ABSTRACT

Disclosed is a securing device (1), comprising a front hood (2) and a hood lock (3) with a lock holder (10), for a motor vehicle; the hood lock (3) includes a rotary latch (4) featuring a pre-locking position and a main locking position, and an electric drive (5) for switching the rotary latch (4) from the main locking position into the pre-locking position, the front hood (2) being closed and locked in the main locking position; in the pre-locking position of the rotary latch, the front hood (2) can be manually moved from a locked position of the front hood (2) in which the lock holder (10) engages the rotary latch (4) and the front hood (2) is locked, into an unlocked position of the front hood (2) in which the (Continued)

Figure 1:
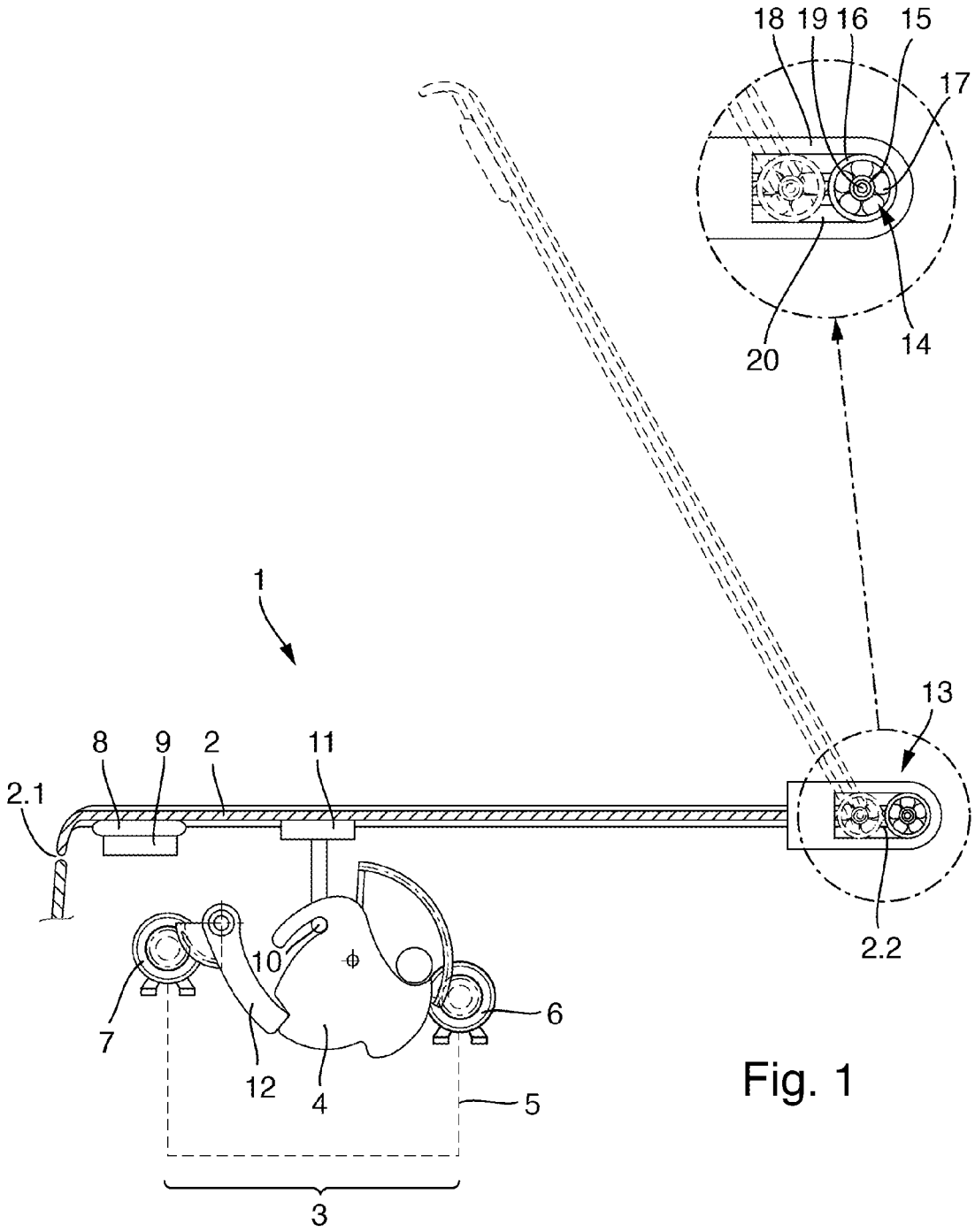

lock holder (10) is released by the rotary latch (4) and the front hood (2) is unlocked.

9 Claims, 4 Drawing Sheets

(51) Int. Cl.

| | |
|---|---|
| ***E05B 81/20*** | (2014.01) |
| ***E05B 83/24*** | (2014.01) |
| ***E05C 19/00*** | (2006.01) |

(56) References Cited

U.S. PATENT DOCUMENTS

| | | | | |
|---|---|---|---|---|
| 10,100,558 | B2 * | 10/2018 | Graute | E05B 81/20 |
| 2006/0175846 | A1 * | 8/2006 | Rice | E05B 81/22<br>292/341.16 |
| 2012/0126551 | A1 * | 5/2012 | Alexander | E05B 81/14<br>292/226 |
| 2014/0088826 | A1 | 3/2014 | Wheeler et al. | |

FOREIGN PATENT DOCUMENTS

| | | | |
|---|---|---|---|
| DE | 10 2007 061 544 | A1 | 6/2009 |
| DE | 102011003808 | | 8/2012 |
| DE | 102013217377 | A1 | 3/2015 |
| DE | 102013112122 | A1 | 5/2015 |
| WO | 2007/031267 | A1 | 3/2007 |
| WO | 2015/113546 | A1 | 8/2015 |

* cited by examiner

SECURING DEVICE COMPRISING A MANUALLY UNLOCKABLE FRONT HOOD

The invention relates to a safety device having a front hood and a hood latch with a striker for a motor vehicle.

Such a safety device is known from DE 198 12 835 A1. The safety device described therein has an arrester hook operating arrangement which is executed by means of a lever construction and in which no rotational constructional elements occur. This safety device is thus characterized by a very simple construction. A first step to unbolt a front hood is usually enabled by means of operating a Bowden cable from the vehicle interior. Thus, for example, in DE 10 2007 061 544 A1 an operating lever is described for unlocking a motor hood which is arranged in the passenger compartment and is mechanically connected to a hood latch by means of a Bowden cable. Furthermore, DE 10 2005 044 079 A1 reveals unlocking of a hood latch by means of a Bowden cable.

Use of a Bowden cable has the disadvantage that this needs to be conducted around several components in the engine compartment starting from the vehicle interior to the front area of the front hood in which the hood latch is arranged, which requires space in the engine compartment and less space is thus available for arrangement of these components in the engine compartment. According to the state of the art, the safety device thus limits options to arrange other components in the engine compartment and is therefore impractical from a manufacturing and constructional perspective. Use of the Bowden cable to unbolt the front hood is also impractical for an operator as he must feel for one end of the Bowden cable when searching for it which is usually located beneath a dashboard and can only move the Bowden cable with considerable physical effort.

It is therefore a task of the present invention to create a safety device of the type stated above which is more practical compared to a previously known safety device.

According to the invention, this task is solved by a safety device with the characteristics of the patent claim. Advantageous designs with expedient further formations of the invention result from the remaining patent claims, the description and the figures.

In order to create a safety device which is more practical compared to a previously known safety device, a safety device for a motor vehicle is provided for which has a front hood and a hood latch with a striker, whereby the hood latch comprises a catch with a pre-ratchet position and a main ratchet position and an electrical drive. The electrical drive causes switchover of the catch from the main ratchet position into the pre-ratchet position, whereby the front hood is locked and closed in the main ratchet position. In the pre-ratchet position of the catch the front hood can be manually transferred from a locking position of the front hood in which the striker engages with the catch and the front hood is locked to an unlocking position of the front hood in which the striker is released from the catch and the front hood is unlocked.

The electrical drive can preferably be controlled, switched on and/or switched off and can preferably be rotatably controlled in a first direction and optionally a second direction which is opposite the first by means of a switch and/or a control device which is connected to the electrical drive by means of at least one cable. In particular, a rotational movement of the electrical drive causes switchover of the catch from the main ratchet position to the pre-ratchet position.

Due to the fact that the electrical drive is connected to the switch and/or the control device by means of a cable, a Bowden cable conducted through the engine compartment can be dispensed with which facilitates the arrangement of other components in the engine compartment. A switch which operates the electrical drive can also be arranged at any position on a motor vehicle dashboard so that the safety device is easier to unbolt and therefore more practical for an operator.

In the main ratchet position, the catch is locked in an opening rotational position which is specified by a rotation of the catch from the main ratchet position into the pre-ratchet position. The catch has an infeed section which is formed by a load arm and an arresting arm, whereby the infeed section encompasses the striker in the main ratchet position such that a movement of the striker is blocked. In particular, the front hood is manually immobile if the catch is located in the main ratchet position, in particular not purely mechanically detachable with a handle. The striker can be executed as a bolt, a pin or a latch bracket and the infeed section can be fork-shaped. In particular, the striker is blocked in the main ratchet position by means of the load arm. The striker can generally be viewed as a connecting element between the catch and the front hood which interacts directly with the catch and can be locked and unlocked with the aid of the catch, whereby locking or unlocking of the striker causes locking or unlocking of the front hood.

According to an advantageous embodiment, the striker is arranged on the front hood and the catch is arranged on a static component of the safety device. In a different embodiment, the striker can also be arranged on a static component of the safety device and the catch can be arranged on the front hood. The greater mass inertia of the front hood can thus reduce a bouncing effect of the front hood which preferably counteracts the load arm of the catch in the pre-ratchet position during closure of the hood.

By means of the electrical drive of the hood latch an arrangement of the catch on the front hood is considerably easier to execute in particular as only a cable needs to be conducted along the movable front hood in this embodiment instead of a Bowden cable. An arrangement of the catch on the front hood can be advantageous from a manufacturing perspective to the extent that the catch and the electrical drive can be better mounted on an individual front hood than in an already equipped engine compartment.

The hood latch preferably has a catch blocking element, such as a pawl, which locks the catch in the main ratchet position and/or the pre-ratchet position, whereby locking means a blocking of the catch in the opening rotational direction. Furthermore, it is within the scope of the invention that the catch has a pre-ratchet contour and a main ratchet contour which can interact respectively independently of one another with a counter ratchet contour of the catch blocking element during rotation of the catch in the opening rotational direction and into a closure rotational direction which is opposite to the opening rotational direction.

Especially advantageously, the pre-ratchet contour or the main ratchet contour passes the counter ratchet contour of the pawl during rotation of the catch in the closure rotational direction. If the pre-ratchet contour or the main ratchet contour is located in front of the counter ratchet contour of the pawl viewed in the closure rotational direction, the counter ratchet contour preferably ratchets in a spring-loaded manner into the pre-ratchet contour or the main ratchet contour and blocks rotation of the catch in the opening rotational direction, whereby the catch assumes the pre-ratchet position or the main ratchet position. Advantageously, a catch spring element acts on the catch in the opening rotational direction, whereby the pre-ratchet contour or the main ratchet contour is held pressed against the counter ratchet contour in the pre-ratchet position or the main ratchet position accordingly. The catch spring element can be tensioned during movement of the front hood in the direction of the closure position, whereby the striker comes into contact with the catch. A tensioned catch spring element can enable an independently driven switchover of the catch from the main ratchet position into the pre-ratchet position, whereby such switchover can be triggered by means of the electrical drive, for example by means of driving of the pawl.

A special configuration envisages that the catch cannot be moved beyond the pre-ratchet position without locking by means of the pawl in the opening rotational direction, i.e. that the catch has an opening end position with the pre-ratchet position. In a different embodiment, the catch has an opening end position in which the catch is rotated into the opening rotational direction from the pre-ratchet position.

The front hood is closed in the main ratchet position of the catch. Closed means that the front hood which is in particular pivotable and/or rotatable in a first direction into an open position and in a second direction, opposite to the first, to a closed position, located in the closed position and cannot be moved via the closure position into the second direction either manually or mechanically. Advantageously, it is envisaged when the front hood is closed that an elastic element of the safety device, such as a sealing rubber which borders the front hood in the closure position or is arranged on the front hood is compressed. A front hood for the purpose of the invention means a hood which is arranged in front of a windscreen of the motor vehicle in the direction of travel of the motor vehicle.

Starting from the main ratchet position of the catch, the electrical drive causes switchover of the catch from the main ratchet position into the pre-ratchet position during its activation or control. The electrical drive can, for example, be activated from the vehicle interior or the vehicle exterior by means of remote control. During switchover from the main ratchet position into the pre-ratchet position, the catch preferably moves the front hood in the direction of the open position of the front hood via the striker. In the pre-ratchet position, the catch is blocked in an opening rotational direction, preferably by means of the pawl, and the striker is engaged with the catch, insofar as the front hood is in the locking position.

According to the invention, the front hood can be transferred in the pre-ratchet position from the locking position to the unlocking position manually, i.e. for an operator of the safety device, whereby the front hood is preferably held in a spring-loaded manner in the locking position. Manually transferred means, for the purpose of the invention, in particular solely mechanically, i.e. without electricity and without electrical aids. In other words, the front hood can be mechanically unlocked by an operator in the pre-ratchet position. Especially advantageously, the safety device has a handle to move the front hood from the locking position to the unlocking position. In detail, a transfer of the handle can also be provided into an accessible operating position during switchover of the catch from the main ratchet position into the pre-ratchet position.

Due to the fact that the front hood is locked in the locking position of the front hood and the pre-ratchet position of the catch, starting from a closed state of the front hood dual operation of the safety device is provided to unbolt the front hood. On the one hand, activation of the electrical drive for switchover of the catch from the main ratchet position into the pre-ratchet position and, on the other hand, manual transfer of the front hood from the locking position into the unlocking position. This redundancy lends the safety device according to the invention greater safety compared to a safety device without additional manual transfer of the front hood into the unlocking position or without operation of an electrical drive.

The switchover of the catch from the main ratchet position into the pre-ratchet position is caused by means of the electrical drive according to the invention, which preferably has a pinion shaft. This can be executed in a special design by means of a triggering lever which is acted on by means of the pinion shaft, whereby the triggering lever causes unratcheting of the catch from the main ratchet position during movement of the pinion shaft. For example, the triggering lever can move the pawl against a spring force which acts on the pawl and move the counter ratchet contour away from the main ratchet contour or release it from the ratchet position. According to this, causing of the switchover of the catch from the main ratchet position into the pre-ratchet position also encompasses triggering of this switchover for the purpose of the invention.

It is furthermore possible that the triggering lever releases a pre-tensioned force spring during movement of the pinion shaft which unratchets the pawl against its spring impingement. The advantage of this variant is that the electrical drive can have smaller dimensions as only the pre-tensioned force spring needs to be detached by means of the drive. However, in this design an additional gearbox can be necessary to tension the force spring by means of the electrical drive. Advantageously the force spring can be tensioned during rotation of the catch in the closure rotational direction, preferably assisted by weight force by means of a movement of the front hood in the direction of the closure position.

A further design can envisage that the pinion shaft of the electrical drive acts directly on the pawl and during activation of the electrical drive the counter ratchet contour unratchets the pawl from the main ratchet contour. The advantage of this design is that no transmission element is necessary between the pinion shaft and the pawl.

The front hood has a front edge, a rear edge and two lateral edges, whereby the front edge lies in front of the rear edge in the direction of travel of the motor vehicle on which the front hood can be mounted. Furthermore, the safety device has an mounting for the front hood, whereby the mounting is equipped with at least a first rotating joint, preferably a second rotating joint, a first connecting element and a second connecting element. Generally, the first and second rotating joint is arranged in the area of the rear edge. The first rotating joint couples the first connecting element rotatably with the second connecting element, whereby the front hood is preferably firmly mounted on the first or the second connecting element. Especially advantageously, the second connecting element is shiftably arranged in respect of the first connecting element in order to provide a movability of the front hood starting from the locking position to the unlocking position.

Advantageously, the first or the second rotating joint is formed in the form of a roller bearing with an internal ring, an external ring and rolling elements. In a special embodiment, the internal ring is shiftably arranged firmly to the second connecting element, the external ring is shiftably arranged to the first connecting element and both connecting elements are rotatably coupled with one another by means of the rolling elements.

A particular possibility envisages that the first rotating joint or the second rotating joint is guided in an elongated hole of the first connecting element or the second connecting element. For example, where the first or second rotating joint is executed as a roller bearing, the external ring can be accommodated in a gliding or rolling manner on a surface of the elongated hole of the first connecting element and the internal ring of the roller bearing can be connected to a pin of the second connecting element.

A further configuration of the mounting envisages an arrangement of four roller bearings in the elongated hole of the first connecting element, whereby the four roller bearings form two roller bearing series arranged above one another, the internal rings of which are firmly connected to a coupling element. In this configuration, the first or second rotating joint rotatably connects the coupling element with the second connecting element. In this configuration, a shiftable coupling of the first connecting element is executed with the second connecting element and thus a shiftability of the front hood with the aid of the shiftability of the four roller bearings within the elongated hole.

Shiftability between the first and the second connecting element can be provided in the form of a purely transmissional shiftability. However, it can be executed in a further configuration by means of a gearbox of the safety device in the form of a combination of a transmission and a rotation. The second connecting element is preferably connected to the front hood in a torqueproof manner and the first connecting element is arranged in a torqueproof manner on a static chassis component of the safety device.

Within the scope of a different configuration, the first and the second connecting element are firmly arranged on the first connecting joint and one of the two connecting elements are shiftably connected on the front hood or on a static chassis component of the safety device.

In a special embodiment, during movement of the front hood from the locking position to the unlocking position, a shifting of the striker guiding away from the mounting is provided. In this embodiment, the striker is located in the unlocking position of the front hood further away from the mounting than in the locking position of the front hood. Furthermore, in this embodiment it can be provided that an opening of the infeed section of the catch in the pre-ratchet position is fundamentally aligned in the direction of the front edge and a movement of the front hood from the locking position to the unlocking position is oriented in the direction of the front edge which is usually associated with a tension impact in the area of the front edge. Such a tension impingement can be connected especially well ergonomically to a subsequent tension impingement of the front edge in the direction of the open position of the front hood. In this embodiment, the operating convenience is therefore high to the extent that a movement for unlocking of the front hood can fluently move into a movement to open the front hood. To this end, a ramp can be advantageously provided which steers a movement of the front edge upwards, i.e. in the direction of the open position. A further advantage of this configuration is that in the area of the mounting of the front hood no additional space needs to be created for a moving rear edge and installation space is thus saved.

In a different variant, the striker is located in the unlocking position of the front hood nearer to the mounting than in the locking position. A movement of the front hood from the locking position to the unlocking position is oriented in the direction of the rear edge which is usually associated with a pressure impingement in the area of the front edge. In this embodiment, an opening of the infeed section of the catch in the pre-ratchet position is fundamentally aligned in the direction of the rear edge. On the one hand, the operating convenience compared to the variant in which the front edge needs to be acted on with tension to unbolt the front hood can be higher as pushing seems less strenuous for an operator than pulling and is simpler from a mechanical perspective as the front hood does not need to be grasped.

On the other hand, the safety device can also provide an element of pedestrian impact protection in this variant. Advantageously the catch can be rotated by means of the electrical drive from the main ratchet position to the pre-ratchet position as soon as an impact is detected. Spring impingement of the front hood in the direction of the closure position, i.e. in the direction of the front edge is provided so that in the pre-ratchet position of the catch an object can be decelerated upon impact on the front hood with a springing effect by means of frictional forces between the object and the front hood in the direction of the front hood. A springing deceleration causes reduction of the maximum delay values of the object and can make a crucial contribution to pedestrian safety. In detail, the safety device can provide a crash sensor in the area of the front edge, with which an impact of an object can be detected with a mass of 30 to 200 kg. In a further configuration, the safety device can provide for transmission of an activation signal on the electrical drive when this impact has been detected which causes switchover of the catch from the main ratchet position into the pre-ratchet position. A combination of characteristics such as the provision of the crash sensor and the movement direction of the front hood from the locking position to the unlocking position which is aligned to the rear edge and the spring impingement of the front hood in the direction of the locking position constitute a safety device with especially great safety together with the object stressed according to the main claim.

Within the scope of an especially preferred variant, the safety device has a mechanical operative connection between the electrical drive and the catch during switchover of the catch from the main ratchet position into the pre-ratchet position. Advantageously, the safety device provides a force-transmitting operative connecting chain in every intermediate position of the catch between the main ratchet position and the pre-ratchet position starting from the electrical drive via the catch to the striker.

For example, the mechanical operative connection can be formed by a pinion gearwheel which is connected to the pinion shaft of the electrical drive in a form-fitting manner and a drive gearwheel which is connected to the catch in a form-fitting manner, whereby the pinion shaft gearwheel combs with the drive gearwheel. Driving of the catch with the aid of the electrical drive during switchover from the main ratchet position into the pre-ratchet position enables smaller dimensioning of the catch spring element, whereby space can be saved in direct proximity to the catch. A special design of the safety device can even provide for no catch spring element at all. The electrical drive can preferably be operated in generator mode in order to form mechanical resistance of the catch against a movement of the front hood in the direction of the closure position during arresting of the front hood.

In a further embodiment, the mechanical operative connection can be formed by means of a wormgear which is connected to the pinion shaft of the electrical drive in a form-fitting manner and a wormgear wheel which is connected to the catch in a form-fitting manner, whereby the wormgear engages into the wormgear wheel. In any case, a mechanical operative connection means that a movement of the pinion shaft directly gives rise to a movement of the catch, i.e. the pinion shaft is mechanically coupled with the catch.

By means of the mechanical operative connection between the electrical drive and the catch it is possible and lies within the scope of the invention that a movement of the front hood in the direction of the open position during switchover of the catch from the main ratchet position into the pre-ratchet position is controllable, i.e. that both an initial acceleration of the front hood and also a decelerating acceleration can be controlled shortly before attainment of the pre-ratchet position of the catch, whereby the initial acceleration and the decelerated acceleration advantageously have a parabola-shaped course over time. For example, the decelerating acceleration can be reduced as the catch approaches the pre-ratchet position, whereby overshooting of the front hood can be minimized after the catch has reached the pre-ratchet position. The striker is therefore simpler to grasp and more convenient unlocking of the front hood can be provided, in particular if an operator is located directly in front of the front hood and activates the electrical drive by means of remote control.

A further variant of the invention envisages that the safety device has a mechanical operative connection between the electrical drive and the catch during switchover of the catch from the pre-ratchet position into the main ratchet position. The mechanical operative connection can be formed as described above, i.e. for example by means of a pinion shaft gearwheel and a drive gearwheel or by means of a wormgear and a wormgear wheel.

The mechanical operative connection between the electrical drive and the catch during switchover of the catch from the pre-ratchet position into the main ratchet position causes a more powerful and, in particular, a controllable ratcheting of the catch into the main ratchet position compared to the state of the art. A more powerful and in particular a controllable ratcheting of the catch enables realization of a smaller gap dimension between the front hood in the closed state and a further chassis component adjacent to the front hood. Advantageously, a force transmission from the electrical drive to the catch is provided which increases during approximation of the catch to the main ratchet position. The elastic element which is adjacent to the front hood when the front hood is closed can thus be compressed, controlled by the electrical drive.

Especially advantageously, the catch can be held in a position by means of the mechanical operative connection between the electrical drive and the catch during switchover of the catch from the pre-ratchet position into the main ratchet position in which the main ratchet contour is located directly in front of the counter ratchet contour of the pawl during a ratcheting process in the closure rotational direction. A holding of the catch in this position, for 10 to 100 milliseconds, for example, enables the ratcheting process of the counter ratchet contour into the main ratchet contour to be delayed at will. In contrast, in the safety device according to the state of the art a pawl spring which moves the counter ratchet contour by means of the pawl into the main ratchet contour must be configured in such a way within a possible ratcheting period which starts with a rotation of the catch in the closure rotational direction with passing of the main ratchet contour on the counter ratchet contour and ends with passing of the main ratchet contour on the counter ratchet contour during rotation of the catch in the opening rotational direction, moves the pawl so quickly that the counter ratchet contour ratchets into the main ratchet contour within the possible ratcheting period. This demands corresponding spring force which needs to be greater the shorter the ratcheting period. According to the state of the art, a possibility of extending the ratcheting period by a gap dimension between the front hood in the closed state and a further chassis component, for example a front headlight, is increased as the path covered by the main ratchet contour within the ratcheting period is increased. Manual holding of the front hood would require excessive physical effort in the case of a low gap dimension in a position in which the main ratchet contour is located directly in front of the counter ratchet contour of the pawl during a ratcheting process in the closure rotational direction.

By means of the mechanical operative connection between the electrical drive and the catch during switchover of the catch from the pre-ratchet position into the main ratchet position the duration of the ratcheting period can be increased at will as the catch can be held by means of the electrical drive in any position for any period. Smaller dimensioning of the pawl spring is thus possible, which saves weight and material costs. The gap dimension between the front hood and the further chassis part can also be considerably reduced as the ratcheting period is no longer dependent on the gap dimension. Such a safety device is therefore more practical from a manufacturing and constructional perspective than one according to the state of the art.

Especially advantageously by means of the elastic element which can be compressed in a controlled manner a gap dimension between the closed front hood and at least a further chassis element, for example a front headlight, can be changed, whereby it is possible to offset manufacturing tolerances which have an impact on a gap dimension between the front hood and the further chassis element. This constitutes a simplification from a manufacturing perspective. In detail, this can be executed with a main ratchet contour of the catch which is adjustable along the opening or closure rotational direction. For example, the main ratchet contour can be arranged on a disk independently of the pre-ratchet contour which can be locked in the opening rotational direction or the closure rotational direction by means of ratchet elements. In detail, the ratchet elements can be locked in adjustable ratchet positions by means of tightening, for example by means of a screw.

Other advantages, characteristics and details of the invention result from the following description at least of a preferred exemplary embodiment to which the invention is not restricted, however, and on the basis of the figures.

Figure 2:
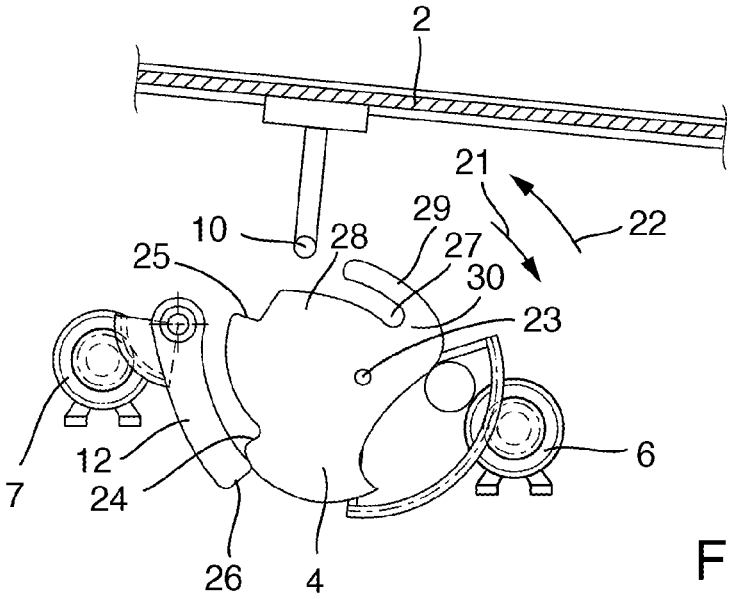
Figure 3:
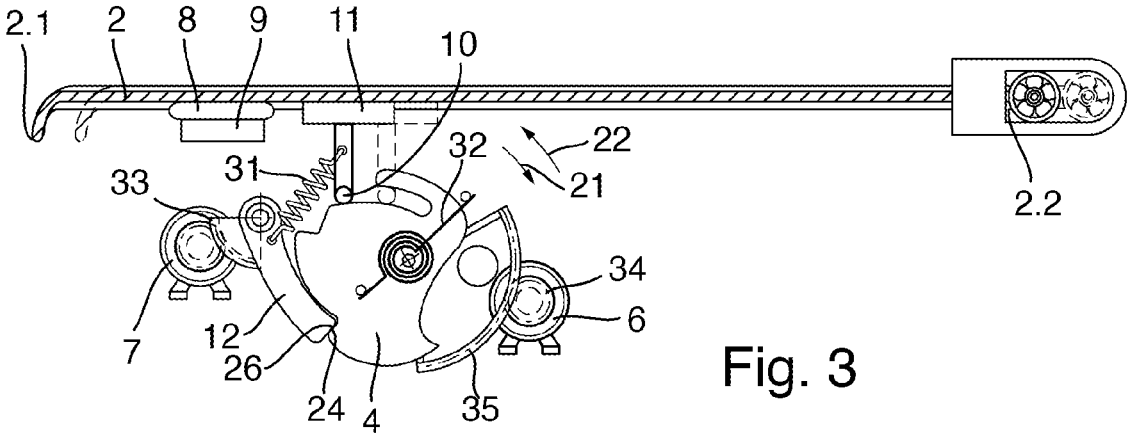
Figure 4:
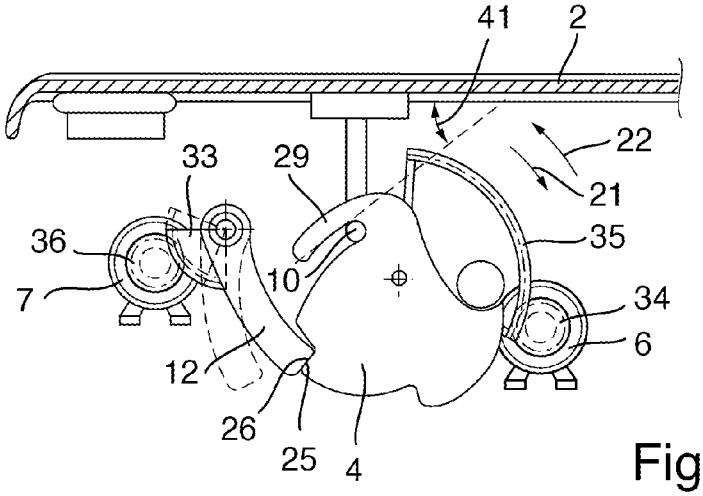
Figure 5:
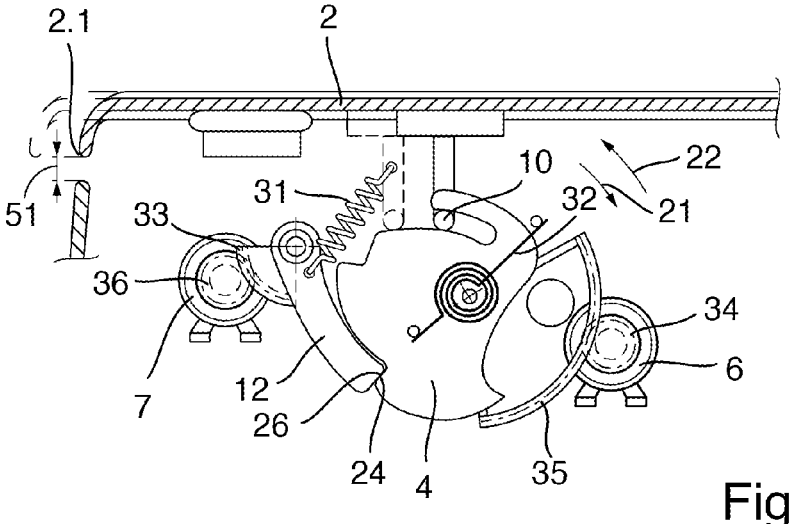
Figure 6:
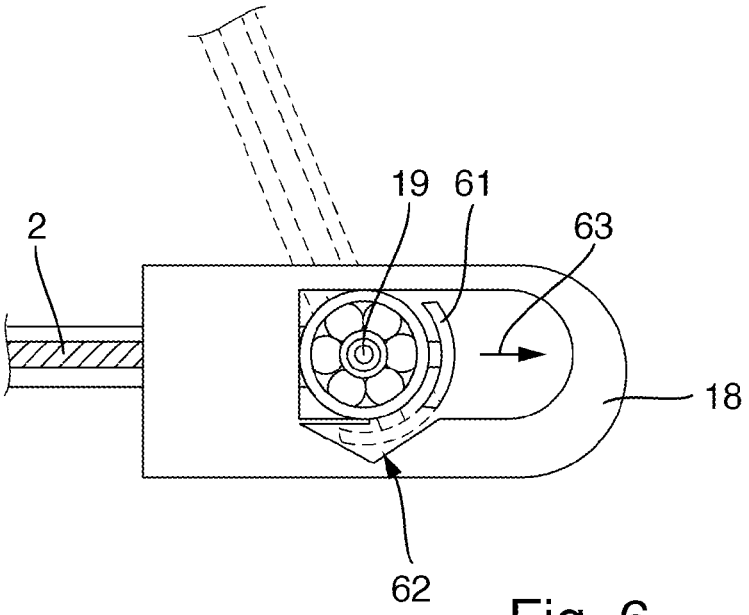

These are demonstrated in:

FIG. 1 a cross-sectional view of a safety device;

FIG. 2 a cross-sectional view of a section of the safety device according to FIG. 1 with a catch in an opening end position;

FIG. 3 a cross-sectional view of a section of the safety device according to FIG. 1 with a catch in a pre-ratchet position;

FIG. 4 a cross-sectional view of a section of the safety device according to FIG. 1 with a catch in a main ratchet position;

FIG. 5 a cross-sectional view of the safety device according to FIG. 1 with the catch in a main ratchet position and a front hood in an unlocking position and in a locking position;

FIG. 6 an mounting for the front hood of the safety device according to FIG. 1.

FIG. 1 shows a cross-sectional view of a safety device 1 with a front hood 2 which has a front edge 2.1 and a rear edge 2.2, a hood latch 3 and an mounting 13. The mounting 13 encompasses a first rotating joint 14, which is equipped with an internal ring 15, an external ring 16 and roller elements 17 and a first connecting element 18 and a second connecting element 19. The external ring 16 is guided in a gliding manner in an elongated hole 20 of the first connecting element 18. The internal ring 15 is firmly connected to the second connecting element 19, which is configured as a pin, and the connecting element 19 is firmly connected to the front hood 2. In this embodiment, the first connecting element 18 is arranged on a static component of the safety device. By means of the roller element 17 the first connecting element 18 is rotatably coupled with the second connecting element 19, whereby the second connecting element 19 is shiftable in the elongated hole 20 compared to the first connecting element 18.

The hood latch 3 has a catch 4 and an electrical drive 5 which encompasses a first electromotor 6 and a second electromotor 7. The catch 4 and a pawl 12 are respectively rotatably arranged on a static component of the safety device 1 which is not illustrated, whereby the catch 4 is located in the position shown in FIG. 1 in the main ratchet position. The front hood 2 is closed in the position shown by means of solid lines in FIG. 1, i.e. it is located in a closure position. In the closure position, an elastic element 8, such as a sealing rubber which is arranged in the closure position between a static component 9 of the safety device 1 and the front hood 2 is compressed. The open position of the front hood 2 is illustrated in dot dashes in FIG. 1. Furthermore, the safety device 1 has a striker 10 which can be executed as a latch bracket, for example, and is attached by means of a coupling element 11 on the front hood 2.

FIG. 2 shows a cross-sectional view of a section of the safety device 1, whereby the catch 4 is located in an opening end position; The catch 4 has a pivot point 23, an opening rotational direction 21 and a closure rotational direction 22 in the opposite direction. In the opening end position, the catch lies adjacent on a stop which is not shown. Furthermore, the catch 4 has a pre-ratchet contour 24 and a main ratchet contour 25, respectively in the form of a protrusion, and an infeed section 27, which is formed by means of an arresting arm 28 and a load arm 29. The pre-ratchet contour 24 and the main ratchet contour 25 can respectively interact with a counter ratchet contour 26 of the pawl 12. The front hood 2 is located in the position shown in FIG. 2 in an intermediate position between the open position and the closed position and is unlocked and released.

FIG. 3 shows a cross-sectional view of a section of the safety device 1, whereby the catch 4 is located in an opening end position. In the pre-ratchet position, the pawl 12 is kept compressed with the aid of a pawl spring element 31, such as a tensioning, compression or spiral spring against the catch 4. Advantageously, the catch 4 is spring-loaded in the pre-ratchet position by means of a catch spring element 32, such as a tensioning, compression or spiral spring, in an opening rotational direction 21, whereby in the pre-ratchet position the pre-ratchet contour 24 is positioned pressing against the counter ratchet contour 26.

Starting from the opening end position of the catch 4 shown in FIG. 2, during a movement of the front hood 2 in the direction of the closure position of the front hood 2 the striker 10 impacts onto the arresting arm 28 and is guided by means of the arresting arm 28 in the direction of an internal end 30 of the infeed section 27, whereby the catch 4 rotates into the closure rotational direction 22. During rotation of the catch 4 in the closure rotational direction 22 up to at least beyond the main ratchet position of the catch 4 the main ratchet contour 24 passes the counter ratchet contour 26 and the pre-ratchet contour 24 is located in the closure rotational direction 22 viewed in front of the counter ratchet contour 26, whereby the contour ratchet contour 26 can ratchet into the main ratchet contour 24 and the catch 4 subsequently assumes the main ratchet position shown in FIG. 3. In the pre-ratchet position, the pawl 12 blocks a rotation of the catch 4 in the opening rotational direction 21.

In FIG. 3, the front hood 2 is shown in an unlocking position by means of solid lines, whereby the front hood 2 is unlocked. By pressing the front hood 2 on the front edge 2.1 in the direction of the rear edge 2.2 the front hood 2 can be transferred into the locking position, i.e. the front hood 2 can be moved manually between the locking position and the unlocking position. The locking position is illustrated in FIG. 3 by means of broken lines. In the locking position the striker 10 is engaged with the catch 4 which is located in the pre-ratchet position, whereby the front hood 2 is locked, i.e. a movement of the front hood 2 is blocked in the direction of the open position. In this embodiment, the striker 10 is located in the unlocking position of the front hood 2 further away from the mounting 13 than in the locking position of the front hood 2.

FIG. 4 shows a cross-sectional view of a section of the safety device 1, whereby the catch 4 is located in the main ratchet position; The main ratchet position is attained by the catch 4 starting from the pre-ratchet position being further rotated in the closure rotational direction 22. In one embodiment, this can be caused by depression of the front hood 2 and in another embodiment by driving of the catch 4 by means of the first electromotor 6. A mechanical operative connection can thus be provided by means of a pinion gearwheel 34 which is connected to a pinion shaft of the first electromotor 6 in a form-fitting manner and a drive gearwheel 35 which is connected to the catch 4 in a form-fitting manner, whereby the pinion shaft gearwheel 34 combs with the drive gearwheel 35. By means of this mechanical operative connection, the catch 4 can be driven during switchover from the pre-ratchet position to the main ratchet position.

A movement of the catch 4 can also be caused in the direction of the main ratchet position by means of a combination of a manual depression and electrical driving of the first electromotor 6.

In an advantageous embodiment, the first electromotor 6 is activated to drive the catch in the closure rotational direction as soon as a movement of the catch 4 is recorded in the closure rotational direction, for example by means of a sensor which can be executed as a multiturn potentiometer. A recording of the movement of the catch 4 in the closure rotational direction can furthermore be facilitated by means of operation of the first electromotor 6 in generator operation, whereby rotation of the catch 4 in the closure rotational direction generates a current flow in the first electromotor 6.

During rotation of the catch 4 in the closure rotational direction 22 up to at least beyond the main ratchet position of the catch 4 the main ratchet contour 25 passes the counter ratchet contour 26 and the main ratchet contour 25 is located in the closure rotational direction 22, whereby the counter ratchet contour 26 can ratchet into the main ratchet contour 24 and the catch 4 subsequently assumes the main ratchet position. Furthermore, FIG. 4 shows a circular static brake blocks to brake the catch 4 in the closure rotational direction, whereby play is present between the catch 4 and the brake block in the main ratchet position in order to enable ratcheting of the catch into the main ratchet position.

In the main ratchet position, the infeed section 27 encompasses the striker 10 and the pawl 12 blocks a rotation of the catch 4 in an opening rotational direction 21, whereby the front hood 2 is locked, closed and blocked in the direction of the unlocking position and in the direction of the open position by means of the load arm 29 of the catch. The load arm 29 is preferably formed in such a way that a main alignment of the load arm 29 assumes an angle 41 of at least 20 degrees in the direction of an opening of the infeed section 27 with a lateral edge of the front hood 2. In a special configuration, this angle 41 can be between 20 and 29, in a different embodiment between 30 and 39, in another variant between 40 and 49 degrees.

In addition to securing of the front hood 2 in the direction of the unlocking position, in the case of a frontal impact in which the catch 4 is pushed in respect of the front hood 2 against the direction of travel of the motor vehicle, this can cause increased pulling of the front hood 2 in the direction of the catch 4 and thus firmer pressing of the front hood 2 onto a further chassis element of the safety device 1, for example the static component 9 and thus reduce a risk of unintentional unlocking of the front hood 2 and provide a more compact and thus crashproof unit consisting of the front hood 2 and the further chassis element. This advantage is provided in particular by means of an arch-shaped infeed section 27 of the catch 4 and by means of the catch 4 as such as a component of the safety device 1.

After the counter ratchet contour 26 is ratcheted into the main ratchet contour 24, the first electromotor 6 is deactivated, where this was activated to switch over from the pre-ratchet position into the main ratchet position. The first electromotor 6 can be operated in generator mode for a short time to record the catch position, preferably intermittently between motor mode and generator mode, whereby in generator mode a current signal is generated differently from zero, insofar as the catch has not yet reached the main ratchet position. After the catch has assumed the main ratchet position, the catch rests and the current signal reaches a zero value in generator mode. Such an operating mode of the first electromotor 6 enables a sensor for recording the catch position or exact fine-tuning of the first electromotor 6 to the geometry of the catch 4 to be dispensed with.

If the front hood 2 is unlocked starting from the main ratchet position, the catch 4 is initially transferred from the main ratchet position to the pre-ratchet position. This can be caused by the second electromotor 7, moving the pawl 12 into the release position illustrated as a broken line in FIG. 4 by means of a pawl pinion gear drive 36 and a pawl drive gearwheel 33 in which the catch 4 is released in the opening rotational direction.

Advantageously, the first electromotor 6 causes switchover of the catch 4 from the main ratchet position shown in FIG. 4 into the pre-ratchet position shown in FIG. 3, whereby the safety device has a mechanical operative connection during this switchover. The mechanical operative connection is formed by means of an output socket gear 34, which is form-fittingly connected to the pinion shaft of the first electromotor 6, and the pinion gear drive 35 which is form-fittingly connected to the catch 4, whereby the output socket gear 34 combs with the pinion gear drive 35. In this switchover of the catch 4 driven by the first electromotor 6, as described above, intermittent operation of the first electromotor 6 is possible which alternates between motor mode and generator mode, whereby it can be recorded when the catch 4 has reached the pre-ratchet position.

In a different embodiment, the catch 4 rotates from the main ratchet position into the pre-ratchet position in a spring-loaded manner by means of the catch spring element 32 after the pawl 12 has reached the release position. A further configuration can envisage an interacting driving of the catch 4 by means of the electromotor 6 and the catch spring element 32. The theory according to the invention does not inevitably provide for electrical driving of the catch 4 during switchover of the catch 4 from the main ratchet position into the pre-ratchet position. Consequently, an embodiment of the theory according to the invention is also possible according to FIGS. 1 to 6 without the first electromotor 6. The switchover of the catch 4 from the main ratchet position into the pre-ratchet position is caused in this case by the second electromotor 7 as described above.

FIG. 5 shows the safety device with the catch in the pre-ratchet position. After switchover from the main ratchet position into the pre-ratchet position of the catch 4 the front hood 2 is located in the locking position illustrated as a broken line in FIG. 3 or as continuous lines as illustrated in FIG. 5. In the pre-ratchet position shown in FIG. 5, the front hood 2 can be manually transferred from the locking position to the unlocking position illustrated as a broken line in FIG. 5 by means of a tension impingement on the front edge 2.1. In the unlocking position the striker 10 is released by the catch and the front hood 2 is unlocked and the front hood 2 can be moved into the open position shown in FIG. 1.

Upon attainment of the open position of the front hood 2 it can be provided for that the catch 4 is transferred from the pre-ratchet position into the opening end position shown in FIG. 2. Advantageously, the pawl 12 can be transferred with the aid of the second electromotor 7 into the release position shown in FIG. 4, whereby a spring-driven rotation of the catch 4 to the opening end position is caused. In a different embodiment, a catch 4 can be provided for which has none of the opening end positions shown in FIG. 2, but comes into contact with a stop in the pre-ratchet position which blocks rotation of the catch 4 in the opening rotational direction 21. Use of a catch 4 which cannot be moved beyond the pre-ratchet position is enabled in particular by shiftability of the front hood 2 from the locking position into the unlocking position.

In a special embodiment, an arrangement of the striker 10 to the catch 4 can be provided for such that the front hood 2 is elevated during switchover from the main ratchet position to the pre-ratchet position around a path 51 which can be approximately 10 cm. Advantageously, such an elevation enables ergonomically beneficial grasping of the front edge 2.1 of the front hood 2, so that pulling of the front hood 2 is facilitated.

FIG. 6 shows a configuration of the mounting 13 with a blocking element 61 and a recess 62 in the first connecting element 18. The blocking element 61 is preferably arranged firmly on the front hood 2 or the second connecting element 19 and rotates during rotation of the front hood 2 in the direction of the open position and closed position. Such a rotation of the blocking element 61 causes insertion of the blocking element 61 into the recess 62 and blocking of a shifting of the second connecting element 19 in respect of the first connecting element 18 in the direction of the locking position of the front hood 2, whereby this direction is illustrated with the arrow 63. The blocking element 61 and the front hood 2 are illustrated as a broken line in FIG. 6 in a state in which the blocking element 61 is inserted into the recess 62. A safety device with a blocking element has the advantage that the front hood 2 is not shiftable or is solely rotatable in the open position or in an intermediate position.

In one embodiment in which a rotation of the catch 4 is blocked in an opening rotational direction 21 via the pre-ratchet position by means of a stop, the striker 10 can be accommodated during movement of the front hood 2 from the open position to the closed position by the arrester arm 28 nevertheless as the blocking element 61 causes a position of the front hood 2 and thus the striker 10 shifted in the direction of the front edge 2.1 and the striker 10 is guided past the load arm 29 during the closure movement of the front hood 2.

The invention claimed is:

1. A safety device comprising:

a front hood, and a hood latch with a striker that is coupled to the front hood, for a motor vehicle, wherein the hood latch has a catch with a pre-ratchet position and a main ratchet position and an electrical drive which causes switchover of the catch from the main ratchet position into the pre-ratchet position, wherein when the catch is in the main ratchet position, the front hood is closed and in a locking position in which the front hood is locked, wherein when the catch is in the pre-ratchet position, the catch is blocked in an opening rotational direction and the striker engages with the catch so that the front hood remains in the locking position, wherein the front hood is manually linearly translatable, when the catch is in the pre-ratchet position, from the locking position of the front hood, to an unlocking position of the front hood in which the striker is released by the catch and the front hood is unlocked, wherein an opening sequence of the front hood includes a first electrical operation in which the switchover of the catch from the main ratchet position into the pre-ratchet position by the electrical drive occurs and the front hood remains in the locking position, and a second manual operation that occurs after the first electrical operation, in which the catch is in the pre-ratchet position and the front hood is manually transferred from the locking position to the unlocking position without the electrical drive.

2. The safety device according to claim 1, wherein the safety device has a mounting for the front hood, wherein the mounting has at least a first rotating joint, preferably a second rotating joint, a first connecting element and a second connecting element and the first rotating joint rotatably couples the first connecting element with the second connecting element and the second connecting element are shifted in respect of the first connecting element.

3. The safety device according to claim 2, wherein the first rotating joint is guided in an elongated hole of the first connecting element or the second connecting element.

4. The safety device according to claim 1, wherein the striker in the unlocking position of the front hood is at a greater distance from the mounting than in the locking position of the front hood.

5. The safety device according to claim 1, wherein the striker in the unlocking position of the front hood is closer to the mounting than in the locking position of the front hood.

6. The safety device according to claim 1, wherein the catch is spring-loaded in the pre-ratchet position.

7. The safety device according to claim 1, wherein the safety device has a mechanical operative connection during switchover of the catch from the main ratchet position into the pre-ratchet position between the electrical drive and the catch.

8. The safety device according to claim 7, wherein the mechanical operative connection is directly connected to each of the catch and the electrical drive.

9. The safety device according to claim 1, wherein the safety device has a mechanical operative connection between the electrical drive and the catch during switchover of the catch from the pre-ratchet position into the main ratchet position.

* * * * *